US010359186B2

(12) United States Patent
Inan et al.

(10) Patent No.: US 10,359,186 B2
(45) Date of Patent: Jul. 23, 2019

(54) FLOW COOLED SOLID STATE LIGHTING WITH PREFERRED OPTICAL AND ADVANCED SENSING FEATURES

(71) Applicant: OZYEGIN UNIVERSITESI, Istanbul (TR)

(72) Inventors: Muhammed Nasir Inan, Istanbul (TR); Mehmet Arik, Istanbul (TR)

(73) Assignee: OZYEGIN UNIVERSITESI, Istanbul (TR)

( * ) Notice: Subject to any disclaimer, the term of this patent is extended or adjusted under 35 U.S.C. 154(b) by 0 days.

(21) Appl. No.: 15/511,170

(22) PCT Filed: Aug. 19, 2016

(86) PCT No.: PCT/TR2016/050298

§ 371 (c)(1),
(2) Date: Mar. 14, 2017

(87) PCT Pub. No.: WO2018/034628

PCT Pub. Date: Feb. 22, 2018

(65) Prior Publication Data

US 2018/0299114 A1 Oct. 18, 2018

(51) Int. Cl.

| | |
|---|---|
| ***F21V 29/83*** | (2015.01) |
| ***F21V 23/00*** | (2015.01) |
| ***F21V 23/04*** | (2006.01) |
| ***F21K 9/232*** | (2016.01) |
| ***F21V 29/77*** | (2015.01) |

(Continued)

(52) U.S. Cl.

CPC ..... *F21V 29/83* (2015.01); *F21K 9/232* (2016.08); *F21K 9/64* (2016.08); *F21V 23/009* (2013.01); *F21V 23/0442* (2013.01); *F21V 29/77* (2015.01); *F21V 29/78* (2015.01); *F21K 9/65* (2016.08); *F21V 3/02* (2013.01);

(Continued)

(58) Field of Classification Search

CPC ..... F21V 29/83; F21V 29/77; F21V 29/75; F21V 23/0442; F21V 23/0435

See application file for complete search history.

(56) References Cited

U.S. PATENT DOCUMENTS

| | | | | |
|---|---|---|---|---|
| 9,851,088 | B2 * | 12/2017 | Harvey | F21L 4/00 |
| 2005/0174780 | A1 * | 8/2005 | Park | F21V 3/02 362/294 |

(Continued)

OTHER PUBLICATIONS

International Search Report for corresponding International Application No. PCT/TR2016/050298.

*Primary Examiner* — William N Harris
(74) *Attorney, Agent, or Firm* — Egbert Law Offices, PLLC

(57) ABSTRACT

A lighting apparatus and system and method for controlled lighting are provided. In one embodiment, a lighting apparatus comprises a heat sink including a center passageway passing from a chimney inlet to a driver circuit housing, a plurality of internal heat sink fins within the center passageway, and a plurality of external heat sink fins adjacent the driver circuit housing. A flow channel is between each set of two adjacent heat sink fins of the plurality of heat sink fins to provide a plurality of internal inlet flow channels and a plurality of external outlet flow channels, with each flow channel aligned with one of a plurality of PCBs, each having an LED mounted thereon.

20 Claims, 12 Drawing Sheets

(51) Int. Cl.

| | |
|---|---|
| ***F21V 29/78*** | (2015.01) |
| ***F21K 9/64*** | (2016.01) |
| ***F21V 3/04*** | (2018.01) |
| ***F21K 9/65*** | (2016.01) |
| ***F21Y 115/10*** | (2016.01) |
| ***F21Y 107/30*** | (2016.01) |
| ***F21V 3/02*** | (2006.01) |
| ***F21V 29/506*** | (2015.01) |

(52) U.S. Cl.
CPC ..... *F21V 3/04* (2013.01); *F21V 29/506* (2015.01); *F21Y 2107/30* (2016.08); *F21Y 2115/10* (2016.08)

(56) References Cited

U.S. PATENT DOCUMENTS

2008/0253125 A1* 10/2008 Kang ..... F21V 29/004 362/294
2008/0316755 A1* 12/2008 Zheng ..... F21V 29/004 362/373
2009/0040759 A1* 2/2009 Zhang ..... F21K 9/00 362/249.01
2009/0080205 A1* 3/2009 Chang ..... F21V 29/75 362/373
2009/0116233 A1* 5/2009 Zheng ..... F21S 2/005 362/234
2010/0207502 A1* 8/2010 Cao ..... F21V 3/00 313/46
2010/0214781 A1* 8/2010 Chiu ..... F21V 3/02 362/249.06
2010/0314985 A1* 12/2010 Premysler ..... F21V 3/02 313/46
2012/0112615 A1 5/2012 Kuenzler
2012/0268936 A1* 10/2012 Pickard ..... F21K 9/90 362/249.02
2013/0051003 A1* 2/2013 Fan ..... F21V 3/02 362/231
2013/0221846 A1* 8/2013 Alexiou ..... F21V 29/75 315/51
2013/0294068 A1* 11/2013 Kuenzler ..... F21V 7/048 362/234
2014/0001956 A1* 1/2014 Ter Weeme ..... F21V 29/004 315/113
2014/0092580 A1* 4/2014 McCollum ..... F21V 29/77 362/84
2014/0240990 A1* 8/2014 Bae ..... F21V 29/70 362/373
2015/0233571 A1 8/2015 Inan et al.
2017/0352605 A1* 12/2017 Bilan ..... F21V 29/507
2018/0106458 A1* 4/2018 Sowden ..... F21V 3/02

* cited by examiner

FLOW COOLED SOLID STATE LIGHTING WITH PREFERRED OPTICAL AND ADVANCED SENSING FEATURES

TECHNICAL FIELD

The present invention relates generally to lighting systems, apparatuses, and methods, and more particularly to LED lamps with a heat sink embedded optical structure.

BACKGROUND

Heat sinks are passive cooling components used for removing the heat released by electronic devices. If the cooling process is performed in a passive manner, the cooling of an electronic device advantageously does not need to be done by using external energy. Heat removal is performed by firstly transmitting heat to heat sink fins from a heat source and then, by means of convection and radiation, transmitting heat into the air through the fins. Light emitting diode (LED) chips or LED packages used in LED lamps for generating light convert the majority of the energy used into heat. The temperature of a chip, which increases together with the heat that cannot be removed, decreases the amount and quality of the generated light, shortens the life of the chip, and may cause the eventual failure of the LED. A heat sink with the required cooling capacity also needs to meet the optical, mechanical and aesthetic criteria of LED lamps to maintain the chip temperature at a secured level.

The amount of heat that is released by high-output LED lamps and is required to be removed is also high. Thus, a problem is the high amount of heat released by small-sized LEDs and electronics that is required to be removed. Furthermore, removing the heat by means of cooling components remaining within size and weight constraints with defined standards is a problem of LED lamps.

Prior LED lamps and heat sinks have not had sufficient capacity that allow for high luminous flux and that perform the cooling required for LED lamps generating high heat. A low weight heat sink that has a high cooling performance, provides the desired luminous flux, has a function suitable for the habits of a usage area, and enables the entire system remaining within the defined form factor limits, is not generally present in the current applications. In prior systems where active cooling is used, the actively cooled heat sink (for example using fans) decreases the reliability of the system and causes extra energy loss. However, in the systems presented as passive, the contact of air with the heat sink fin surfaces is inefficient and heat sink sizes increase according to the ground.

Optical design also plays an important role to extract the maximum amount of lumens from a lighting system. In many instances, the optics used in lighting require a precise thermal solution to avoid thermal related optical losses. An effective lighting system should have a hybrid thermo-optical approach but many systems perform this separately. A joint design will bring maximum lumen extraction at less heat sink weight and size.

Internet of things (IOT) brought lighting systems into a new platform. With IOT, many sensors can be incorporated with the lighting system and data can be collected and transmitted to a remote location or be made available online. Sensing desired parameters and then collecting and transmitting data is rather new and many inventions are necessary to find the most optimal approach.

As a result of the above-mentioned drawbacks and the insufficiencies of prior solutions in lighting systems, an improvement is required to be made in the related technical field.

SUMMARY

The present invention addresses these problems by providing a highly efficient lighting apparatus and controlled lighting system and method that enables air to efficiently flow and perform the cooling process, and in particular to perform the cooling process for the LEDs, phosphor, and the driver circuit. The lighting apparatus, system, and method can be combined with the preferred optical features and sensing, data collection and data sharing features.

In accordance with an embodiment of the present invention, a lighting apparatus comprises a connection socket adapted to transmit electricity, a plurality of printed circuit boards (PCBs), an LED (or LEDS) mounted on each of the plurality of PCBs to thereby provide a plurality of LEDs, a diffuser positioned over the LEDs to diffuse light generated by the LEDs, and an electronic driver circuit electrically connected to the connection socket and to the PCBs so as to convert electricity from the connection socket to an electrical output that operates the LEDs, the electronic driver circuit mounted in a driver circuit housing. The lighting apparatus further comprises a heat sink including a center passageway passing from a chimney inlet to the driver circuit housing, a plurality of internal heat sink fins within the center passageway, and a plurality of external heat sink fins adjacent the driver circuit housing. A flow channel is between each set of two adjacent heat sink fins of the plurality of heat sink fins to provide a plurality of internal inlet flow channels and a plurality of external outlet flow channels, with each flow channel aligned with one of the plurality of PCBs.

In accordance with another embodiment, a lighting apparatus comprises a connection socket adapted to transmit electricity, a plurality of printed circuit boards (PCBs), an LED (or LEDs) mounted on each of the plurality of PCBs to provide a plurality of LEDs, a diffuser positioned over the LEDs to guide and diffuse light generated by the LEDs, and an electronic driver circuit electrically connected to the connection socket and to the PCBs so as to convert electricity from the connection socket to an electrical output that operates the LEDs, the electronic driver circuit mounted in a driver circuit housing. The lighting apparatus further comprises a heat sink including: a center passageway passing from a chimney inlet to the driver circuit housing, the chimney inlet allowing air to enter into the center passageway; a plurality of internal heat sink fins within the center passageway and cooperative with the LEDs, wherein the plurality of internal heat sink fins extend between the driver circuit housing and the chimney inlet; a plurality of external heat sink fins adjacent the driver circuit housing and cooperative with the driver circuit, wherein the plurality of external heat sink fins extend between the driver circuit housing and the diffuser; and a flow channel between each set of two adjacent heat sink fins of the plurality of heat sink fins to provide a plurality of internal inlet flow channels and a plurality of external outlet flow channels, with each outlet flow channel aligned with one of the plurality of inlet flow channels and one of the plurality of PCBs. The lighting apparatus further comprises a plurality of mounting plates, each mounting plate having a first end positioned adjacent to said chimney inlet and a second end positioned adjacent to an intersection between the plurality of heat sink fins and the diffuser. Each of the plurality of PCBs is mounted on a mounting plate, and is angularly positioned concentric about the center passageway between the diffuser and the chimney inlet, at an angle (m) between 70 degrees and 90 degrees from a face of the chimney inlet.

In accordance with yet another embodiment of the present invention, a method for controlled lighting comprises providing a lighting apparatus in accordance with embodiments as disclosed above and including: a sensor or a group of sensing apparatuses within a flow channel or the center passageway, with the sensor configured to detect one of temperature, visible radiation, combustion product, orientation, sound, motion, and humidity; and a transceiver configured to send and receive data through an access point to the Internet. The method further comprises sensing a parameter with the sensor, transmitting a parameter data signal through the transceiver regarding the parameter, and receiving a control signal through the transceiver regarding the parameter.

By placing heating elements near to a center pathway entry or the chimney inlet, air is heated and passively flows upward by a "chimney effect" through the center passageway and the inlet and outlet flow channels, thereby allowing cooling fluid to wash over surfaces to receive and transfer heat to the surrounding air environment.

DESCRIPTION OF THE FIGURES

Lighting systems, apparatuses, and methods for controlled lighting with cooling according to the invention and some particular embodiments thereof will be described with reference to the following figures. These and other features, aspects, and advantages of the present invention will become better understood when the following detailed description is read with reference to the accompanying drawings in which like characters represent like parts throughout the drawings. Some embodiments are illustrated by way of example and not limitation in the figures of the accompanying drawings. Unless noted, the drawings may not be drawn to scale.

DETAILED DESCRIPTION

Various modifications to the example embodiments set forth herein will be readily apparent to those skilled in the art, and the generic principles defined herein may be applied to other embodiments and applications without departing from the scope of the invention. Moreover, in the following description, numerous details are set forth for the purpose of explanation. However, one of ordinary skill in the art will realize that the invention may be practiced without the use of these specific details. In other instances, well-known structures and processes are not shown in block diagram form in order not to obscure the description of the invention with unnecessary detail. Thus, the present disclosure is not intended to be limited to the embodiments shown, but is to be accorded the widest scope consistent with the principles and features disclosed herein.

Referring now to the figures, FIGS. 1A through 3B illustrate different views and parts of a lighting apparatus in accordance with some embodiments of the present invention, and FIGS. 3A through 9 further illustrate different and alternative aspects of a lighting apparatus in accordance with some embodiments of the present invention.

Figure 1A:
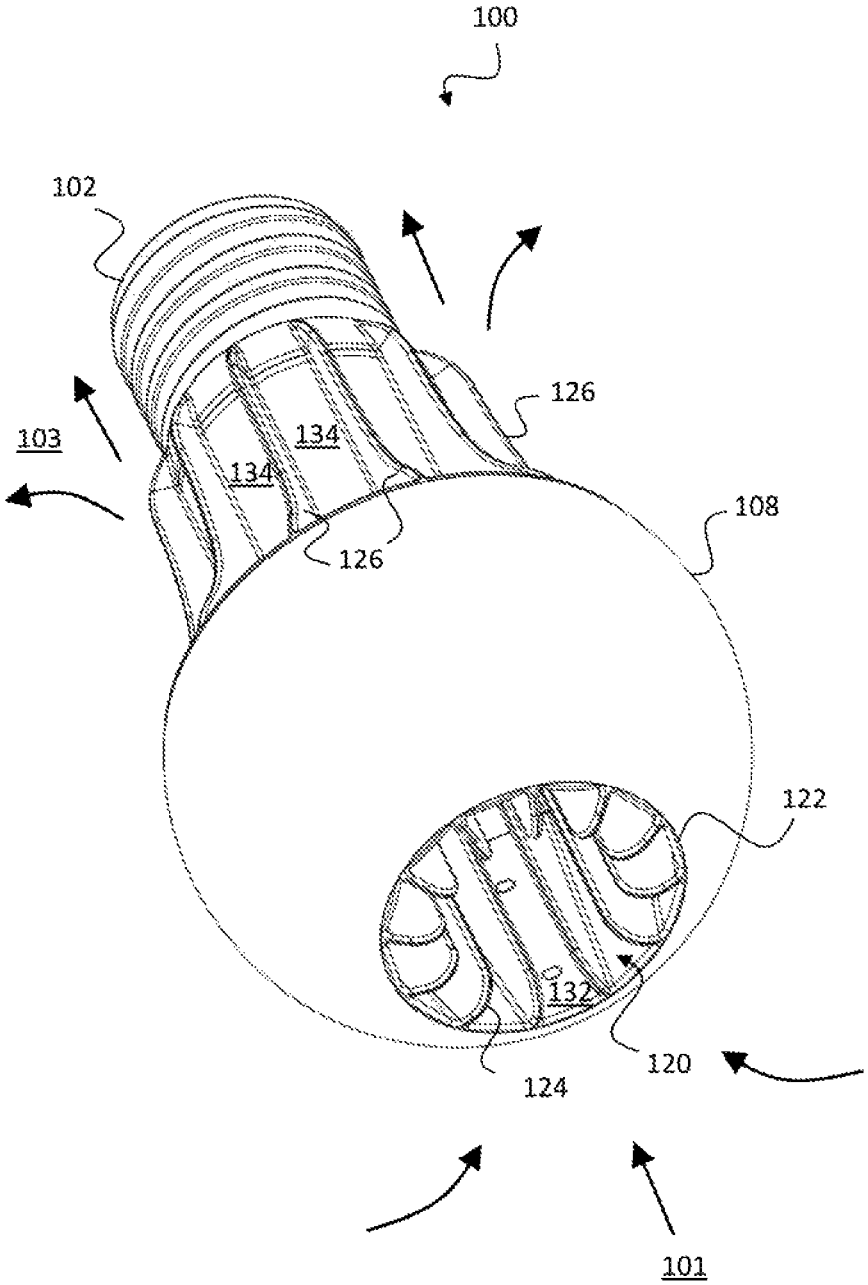
FIG. 1A illustrates a perspective view of a lighting apparatus in accordance with embodiments of the present invention.
Figure 1B:
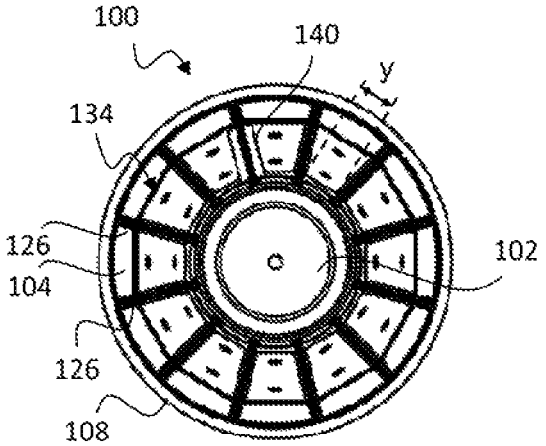
FIGS. 1B-1D illustrate a top view, a side view, and a bottom view, respectively, of the lighting apparatus of FIG. 1A in accordance with embodiments of the present invention.
Figure 1C:
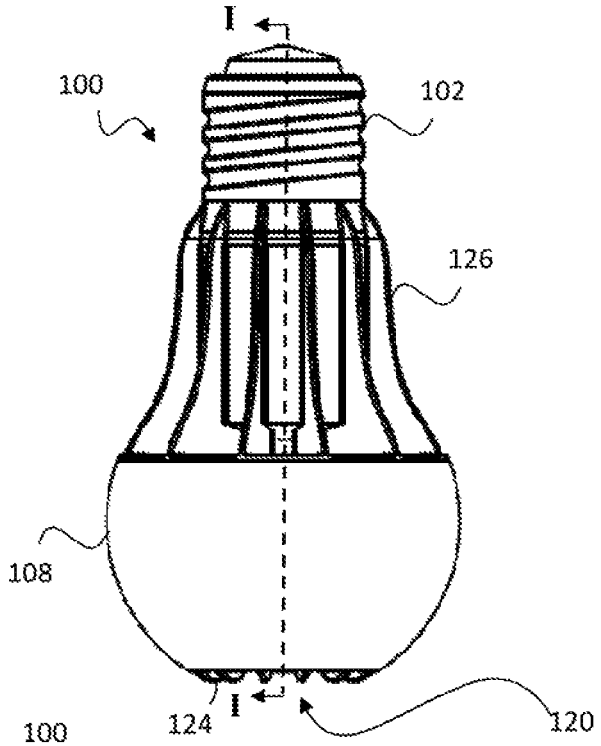
Figure 1D:
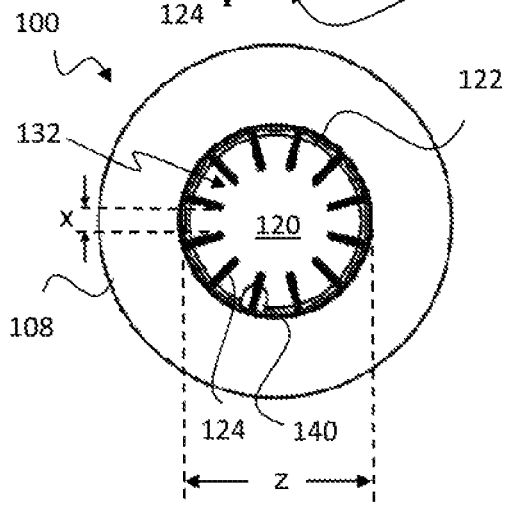
Figure 1E:
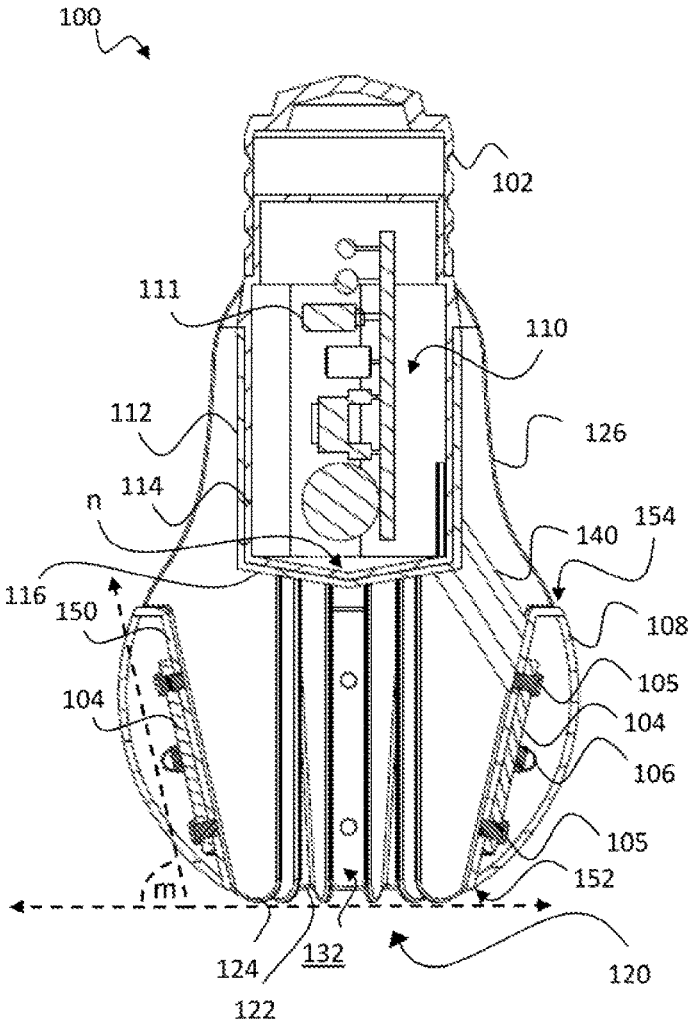
FIG. 1E illustrates a sectional view of the lighting apparatus of FIGS. 1A-1D along a line I-I of FIG. 1C in accordance with embodiments of the present invention.
Figure 1F:
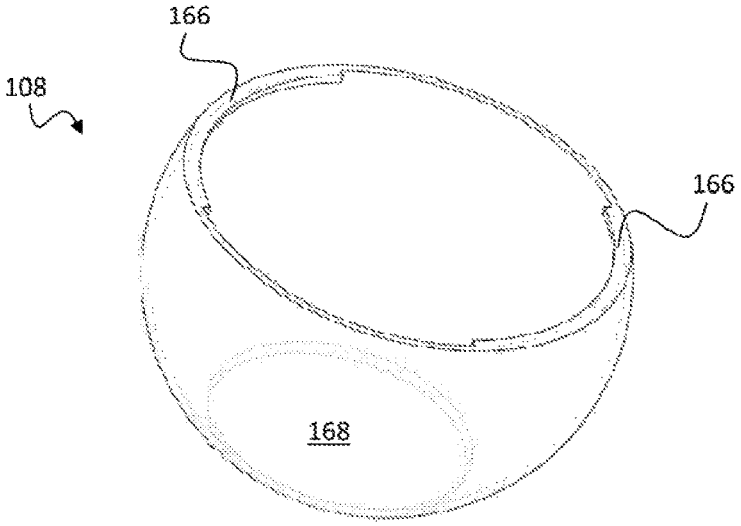
FIG. 1F illustrates a perspective view of a diffuser of the lighting apparatus of FIGS. 1A-1E in accordance with embodiments of the present invention.

In particular, FIG. 1A illustrates a perspective view of a lighting apparatus 100 in accordance with embodiments of the present invention, and FIGS. 1B-1D illustrate a top view, a side view, and a bottom view, respectively, of lighting apparatus 100 of FIG. 1A in accordance with embodiments of the present invention. FIG. 1E illustrates a sectional view of lighting apparatus 100 of FIGS. 1A-1D along a line I-I of FIG. 1C in accordance with embodiments of the present invention. FIG. 1F illustrates a perspective view of a diffuser of the lighting apparatus of FIGS. 1A-1E in accordance with embodiments of the present invention. Inlet air is illustrated by arrows 101 and outlet air that is transferring heat is illustrated by arrows 103 (FIG. 1A).

Figure 2A:
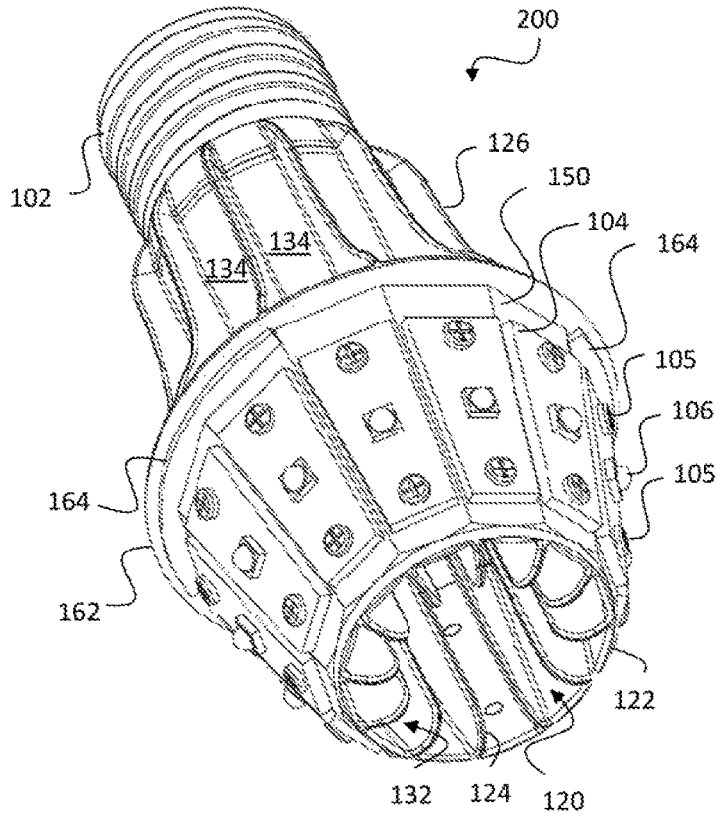
FIG. 2A illustrates a perspective view of the lighting apparatus of FIGS. 1A-1E without the diffuser of FIG. 1F in accordance with embodiments of the present invention.
Figure 2B:
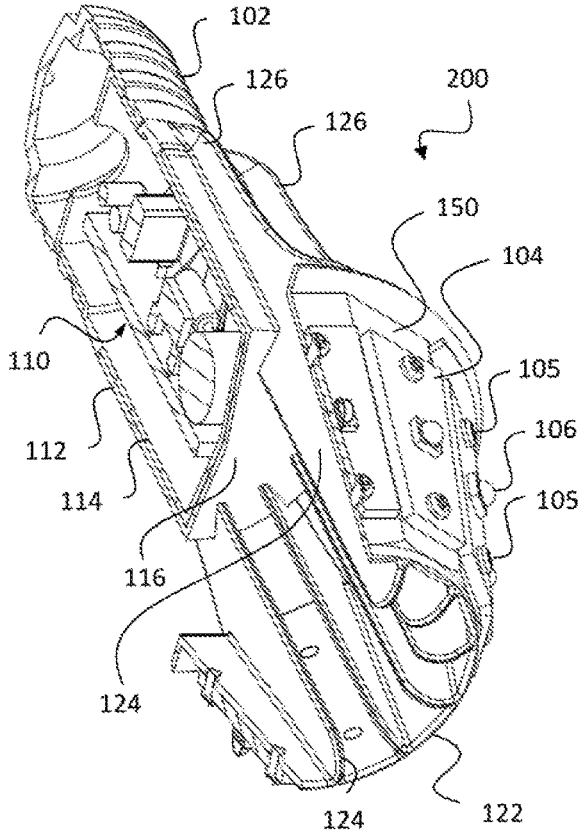
FIG. 2B illustrates a sectional view of the lighting apparatus of FIG. 2A along a line II-II of FIG. 2D in accordance with embodiments of the present invention.
Figure 2C:
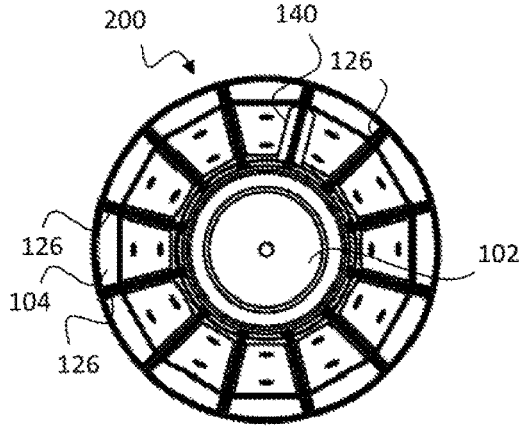
FIGS. 2C-2E illustrate a top view, a side view, and a bottom view, respectively, of the lighting apparatus of FIGS. 2A and 2B in accordance with embodiments of the present invention.
Figure 2D:
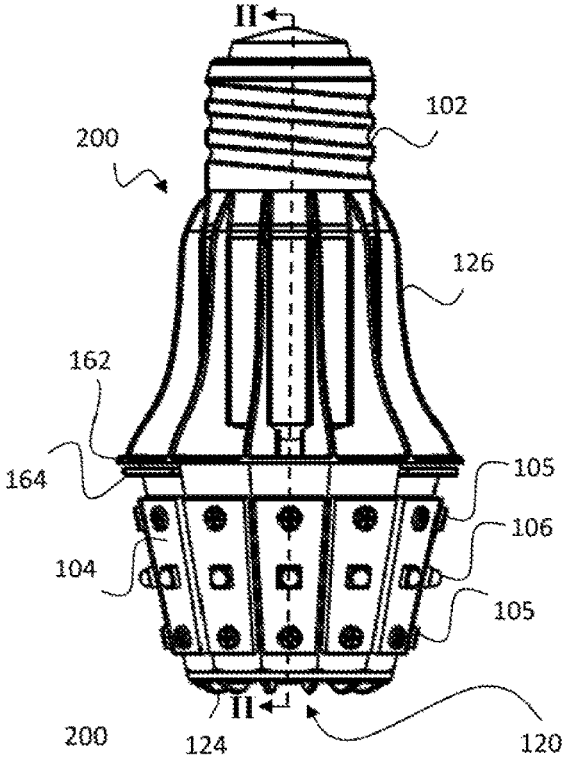
Figure 2E:
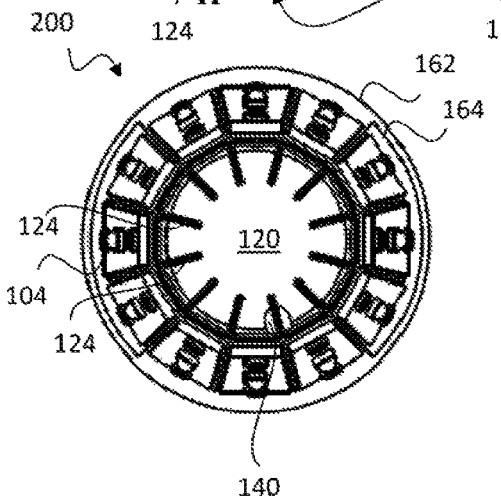

FIG. 2A illustrates a perspective view of a lighting apparatus 200, which is the lighting apparatus 100 of FIGS. 1A-1E without a diffuser (e.g., diffuser 108) in accordance with embodiments of the present invention. FIG. 2B illustrates a sectional view of the lighting apparatus 200 of FIG. 2A along a line II-II of FIG. 2D in accordance with embodiments of the present invention. FIGS. 2C-2E illustrate a top view, a side view, and a bottom view, respectively, of lighting apparatus 200 of FIGS. 2A and 2B in accordance with embodiments of the present invention.

Figure 3A:
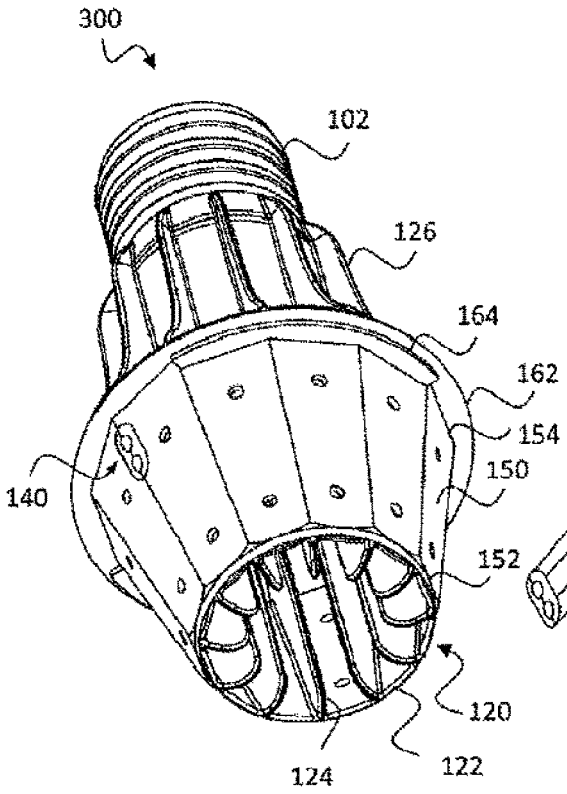
FIGS. 3A-3B illustrate perspective views of the lighting apparatus of FIGS. 1A-1E and 2A-2E without the diffuser and printed circuit boards in accordance with embodiments of the present invention.
Figure 3B:
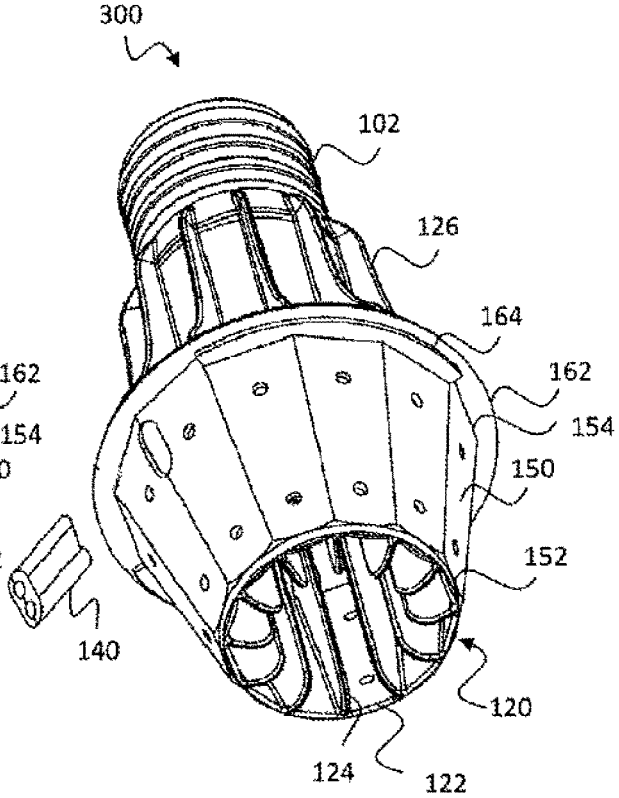

FIGS. 3A-3B illustrate perspective views of a lighting apparatus 300, which is the lighting apparatus 100 of FIGS. 1A-1E and the lighting apparatus 200 of FIGS. 2A-2E without the diffuser and printed circuit boards in accordance with embodiments of the present invention.

In accordance with one embodiment, lighting apparatus 100 comprises a connection socket 102 adapted to transmit electricity, a plurality of printed circuit boards (PCBs) 104, an LED 106 mounted on each of the plurality of PCBs 104 to provide a plurality of LEDs, a diffuser 108 positioned over the LEDs 106 to diffuse (and guide in some examples) light generated by the LEDs, and an electronic driver circuit 110 (including control components) electrically connected to the connection socket 102 and to the PCBs 104 so as to convert electricity from the connection socket 102 to an electrical output that operates the LEDs 106, the electronic driver circuit 110 mounted in a driver circuit housing 112. Lighting apparatus 100 further comprises a heat sink including a center passageway 120 passing from a chimney inlet 122 to the driver circuit housing 112, a plurality of internal heat sink fins 124 within the center passageway 120, a plurality of external heat sink fins 126 adjacent the driver circuit housing 112, and a flow channel between each set of two adjacent heat sink fins of the plurality of heat sink fins to provide a plurality of internal inlet flow channels 132 and a plurality of external outlet flow channels 134, with each flow channel aligned with one of the plurality of PCBs 104. In other words, a flow channel is formed by and between two adjacent heat sink fins, with the heat sink fins aligned with the intersection between adjacent PCBs.

Inlet air 101 enters the center passageway 120 through chimney inlet 122 and contacts the interior surfaces of center passageway 120, including the internal heat sink fins 124 and the internal (or backside) surface of the heat sink base, which is comprised of mounting plates 150 (FIGS. 1E, 2A-2B, 3A-3B) for mounting PCBs 104. Inlet air 101 removes heat from heat sink fins 124 and mounting plates 150, and cools the fins and mounting plates. Internal heat sink fins are in thermal contact with PCBs 104 and LEDs 106. Fins are also cooled with radiative heat transfer as well as convection. Air passes through the center passageway 120 along the internal inlet flow channels 132, contacts driver circuit housing 112, and exits as outlet air 103 to the outer environment via external outlet flow channels 134 formed from external heat sink fins 126.

The above lighting apparatus may have the following alternative components, which may also be combined in various applicable and functioning combinations within the scope of the present invention.

In accordance with an embodiment, the chimney inlet 122 may have a diameter z which is substantially similar to or approximately the same as the diameter of driver circuit housing 112. In accordance with an embodiment, each flow channel 132 and 134 may have a widest width x and y, respectively, between 3 mm and 5 mm (see, for example, FIGS. 1B and 1D).

In accordance with an embodiment, each of the plurality of PCBs 104 are angularly positioned concentric about the center passageway 120 at an angle m between 70 degrees and 90 degrees from a face of the chimney inlet 122 (as shown by the horizontal dashed line in FIG. 1E).

Diffuser 108 includes an opening 168 to accommodate the heat sink's chimney inlet 122 of center passageway 120, as shown in FIG. 1F.

Advantageously, the lighting apparatus of the present invention is thermally and optically optimized. The base angle m of the plurality of PCBs is optimized for minimum space inside the diffuser, a larger center passageway, a larger chimney inlet, and thus an increased cooling volume inside the heat sink. The volume of typical bulbs, such as the A-line (A19) bulb, may be efficiently utilized, such that a larger volume for cooling fins in a larger chimney, and thus a larger cooling capacity for the LED bulb, may be realized. Unused space volume inside the diffuser is reduced. Free space inside the diffuser is filled with heat isolating air and wastes an important part of reserved volume with no main thermal or optical purposes. A larger area for the 3D heat sink base (comprised in part of a plurality of mounting plates 150) is provided, which allows for less intersection between heat zones of LEDs and a larger heat spreading area.

Figure 8:
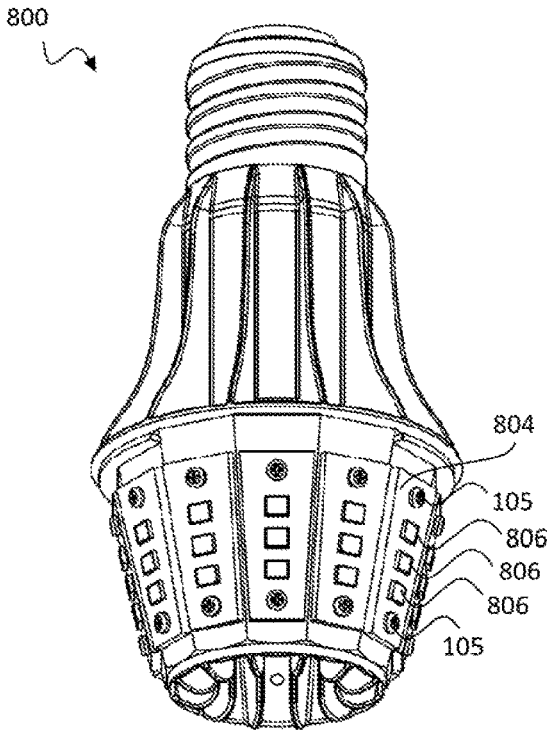
FIG. 8 illustrates a lighting apparatus with groups of LEDs per channel in accordance with embodiments of the present invention.

The larger heat sink base area provides a larger area for using a greater number of LEDs and wire connectors for each PCB. In one example, but not limited thereto, a larger heat sink base area allows for the use of mid-power LEDs in a larger number for better thermal management by decreasing the heat flux per LED and using cheaper LED packages. Thus, in one example, groups of LEDs may be applied onto the mounting plates (e.g., as illustrated in FIG. 8). This also makes easy and reliable assembly of light engines possible thanks to wire connectors.

The base angle m being greater than 70 degrees also provides increased omni-directional intensity distribution. The critical base angle provides a homogenous omni-directional intensity distribution even for LEDs with a Lambertian distribution. Forward light intensity is moved to sideways and backwards for a better omni-directional intensity distribution. Accordingly, in one example, the diffusion property of the dome for an omni-directional intensity distribution is not required, since it already has an omni-directional intensity distribution without guiding light with a dome having a diffusion and guiding property. Thus, in one example, a high transparent material, such as glass, is possible for the protection of the light engine, which minimizes the light absorption on this component. Further, diffuser outlines may be formed based on the form factor outlines. It is noted that diffuser 108 protects the LEDs and at the same time diffuses light emitted by the LEDs in accordance with desired standards (which in one example may be highly transparent).

By the new chimney design, a larger air inlet (e.g., wider interior inlet flow channels and larger chimney inlet diameter) and larger air outlet (e.g., wider exterior outlet flow channels) are provided. Cooling capacity of the driver circuit housing is better utilized due to the fact that natural convection is well organized in the center passageway. Furthermore, the direction of natural convection flows does not sustain important angle changes through the chimney inlet and center passageway. Thus, the critical base angle guides strong natural convection flows.

In accordance with an embodiment, the plurality of external heat sink fins 126 extend between the driver circuit housing 112 and the diffuser 108, and the plurality of internal heat sink fins 124 extend between the driver circuit housing 112 and the chimney inlet 122. In accordance with an embodiment, the plurality of heat sink fins 124 and 126 numbers 12 fins when heat sink fin 124 and 126 are considered to be formed as a single part or fin with adjacent fins forming flow channels (e.g., see FIGS. 1E and 2B, internal heat sink fins 124 and corresponding external heat sink fins 126 formed as a single part, piece, or member). In other embodiments, it is possible that heat sink fins 124 and 126 are formed as separate parts or members. In one example, the heat sink fins may be comprised of a metal, conductive plastics, or a material such as graphite or graphene with a high thermal conductivity, and may be produced by CNC machining, casting, or 3D/additive manufacturing.

Advantageously, the number of fins is reduced to a lower number and flow channel widths are optimized. In one example, heat sink fins are flat and not curved, and the minimum space between adjacent fins is about 4 mm in one example (as compared to prior lighting apparatus with fin space being about 1 mm). By reducing the number of fins and using flat fins, a dense fin structure is removed and a wide range for the optimization of heat sink parameters (e.g., heat sink base thickness, fin length, fin thickness, fin spacing, and the like) is provided for various light engine and driver designs with different heat source profiles. By reducing the fin number and using flat fins, the material requirement and weight of a lighting apparatus are reduced.

Furthermore, by reducing the fin number and using flat fins, a weaker thermal connection is formed between LEDs and the driver housing of the heat sink, which provides for improved cooling of the electronic driver circuit. Cooling of the electronic driver circuit is important due to the fact that the capacitor of an electronic driver circuit is the lowest rated part, and a high heat flux is existent on driver components. It was observed that both an electronic driver circuit and LEDs were optimally maintained in safe and efficient temperature regions due to the large cooling volume reserved by the center passageway.

Furthermore, by reducing the fin number and using flat fins, the fin resistance to natural convection flows are reduced, and stronger natural convection flows are obtained. A dense fin design will disadvantageously absorb the thermal radiation emitted by the fins, the surfaces of which may have been anodized or covered with high absorbing coating. The present invention lighting apparatus provides a higher heat transfer by thermal radiation.

In accordance with an embodiment, the driver circuit housing 112 has a right circular cone surface with an apex centered about the center passageway 120, the cone surface having an apex angle n between 150 degrees and 180 degrees in one example, and greater than 120 degrees in another example (see, for example, FIG. 1E).

Advantageously, an increased apex angle n or guide angle of the driver circuit housing reduces the material requirement and weight. Furthermore, the thermal resistance between the heat generating electronic driver circuit and the flow guide surface 116 (FIGS. 1E and 2B) in the center passageway is reduced due to the reduced thermal path. Lower temperatures were obtained on the electronic driver circuit by the increased apex angle. Furthermore, natural convection flows for heat sink fins are efficiently utilized due to the increased contact area of fins.

Connection socket 102 provides electricity transfer from an electric source to the lighting apparatus. In accordance with an embodiment, the connection socket 102 is suitable for various lamp sockets, including but not limited to standard indoor A19, PAR38, MR16, PAR20, and downlight type of lamps. Similar and other lamps with different form factors, outdoor lamps, and new-generation lamps, are also suitable.

In accordance with an embodiment, lighting apparatus 100 further comprises a cable channel 140 within one of the plurality of heat sink fins between a PCB 104 and the driver circuit 110. In particular, FIGS. 1E and 3A-3B illustrate cable channel 140, which can include 2 ports, in one example, for passing of electrical wire between the driver circuit 110 and PCBs 104. Thus, in one example, a 2-pole cable channel is added inside a fin (or in other embodiments, multiple fins). Cable channel 140 enters the heat sink base and connects to a corner of the driver circuit housing 112. In one example, cable channel 140 is formed of an electrically isolating material, and provides a safe electrical connection by isolating the wires from outside. Two channels are reserved for both poles, which are connected to electronic driver circuit 110. Two cables of two different poles may be soldered to solder points on both PCBs near to the cable channel or placed on wire connectors on both PCBs near to the cable channel. Advantageously, since the cable channel 140 is optimally placed through a fin, natural convection development is minimally effected, and heat is still conducted through the fin (in other words, the cable channel does not prevent heat conduction).

PCBs 104 provide a thermal connection between the mounting plates and LEDs, electrical insulation, and the transfer of electricity into the LED chip. The PCBs may be connected to the electronic driver circuit in a series or parallel circuit. In accordance with an embodiment, PCBs are electrically connected to each other by soldering or placing cables between connectors, which are placed on each PCB. In accordance with an alternative embodiment, PCBs may be connected during manufacturing (for example utilizing a wire frame) and attached at once. Accordingly, multiple light engines (e.g., 12) can be in communication with each other such that the multiple light engines can be attached to the heat sink base in one drop. It is noted that the LED chips placed onto a circuit board to form light engines may have both chip on board and package on board features.

In accordance with an embodiment, the heat sink further comprises a driver circuit housing 112 positioned opposite chimney inlet 122 and providing an isolated housing for the electronic driver circuit 110, the driver circuit housing 112 having a conical section positioned at least partially within the center passageway 120 (see, for example, FIGS. 1E and 2B). Driver circuit housing 112 provides electrical insulation between the electronic driver circuit and the heat sink. In accordance with some examples, circuit housing can be comprised of a plastic plate, or be comprised of silicon, epoxy resin, or polyurethane. Advantageously, in one embodiment, circuit housing 112 may be comprised of the entire interior surface of the heat sink which is reserved for the driver circuit 110. Accordingly, driver circuit 110 may be isolated from the heat sink without using any fill materials in between if the heat sink is comprised of electrically non-conductive material. Otherwise, an insulation layer may be required. In accordance with an embodiment, driver circuit 110 may be housed within a separable isolator 114 (e.g., isolator 414 in FIG. 4) that can be mounted onto driver circuit housing 112. In other embodiments, driver circuit housing 112 need not be separable.

In accordance with an embodiment, the lighting apparatus 100 may further include phosphor positioned at a location selected from the group consisting of a lower surface of the diffuser, on an LED package, within the diffuser, and a combination thereof. Thus, in some embodiments, the three conditions can be applied in the same embodiment, and the phosphor can be present in the form of a layer or particles. In embodiments including phosphor, air may cool the LED chips, electronic driver circuit, and also the phosphor. Thus, local hot spots occurring on phosphor may be eliminated and the performance of light extraction can be increased by controlling phosphor temperature.

Other optical pathways include a highly transparent silk fibroin material, which may be utilized at the chip surfaces with phosphor or alone, at the frontal glass replacement (a diffuser), and/or with phosphor that is mixed with silk fibroin and coated under the glass cover.

In accordance with an embodiment, the lighting apparatus 100 may further include a plurality of mounting plates 150 angularly positioned concentric about the center passageway 120 and between the diffuser 108 and the chimney inlet 122, each of the plurality of mounting plates 150 positioned at an angle m between 70 degrees and 90 degrees from a face of the chimney inlet.

In accordance with an embodiment, each of the plurality of mounting plates 150 may have a first end 152 positioned adjacent to said chimney inlet 122 and a second end 154 positioned adjacent to an intersection between the plurality of external heat sink fins 126 and the diffuser 108. The intersection is at a ridge 162 in one example (see, for example, FIGS. 2A-2B and 3A-3B). Diffuser 108, such as a diffuser dome illustrated in FIG. 1F, may be fastened using ridges 162, 164 of the heat sink in conjunction with a rim 166 of diffuser 108 and screws, adhesive, or other attachment means (see also, for example, FIGS. 2A-2B and 3A-3B).

Each of the plurality of mounting plates 150 includes screw guides for each PCB as an example of PCB attachment means. PCBs are fastened onto the mounting plates by screws 105, which hold the PCB very tightly in position even after large numbers of thermal cycles. In one embodiment, screw holes through the PBC have a greater diameter than mounting plate screw holes or guides in order to prevent the bending of the PCB by reserving space for expansion from higher temperatures.

The electronic driver circuit 110 brings electricity received from the connection socket to a desired electrical output for operating the LEDs. The electricity transmission between the electronic driver circuit and LEDs is achieved by means of connection cables as noted above. It is further noted that in accordance with alternative embodiments, driver electronics can be an ASIC chip located at the PCB light engine or at the topside within a circuit housing at an end of the center passageway. Thus, it is noted that circuit boards with electronic circuit members operating the LED chips may be positioned within a driver circuit housing, on the heat sink between the diffuser and fins, or in both areas in part.

It is further noted that a reflector (e.g., divider 902 in FIG. 9) can be integrated inside the light engine in order to reduce absorption loses on PCBs and mounting plates.

Figure 4:
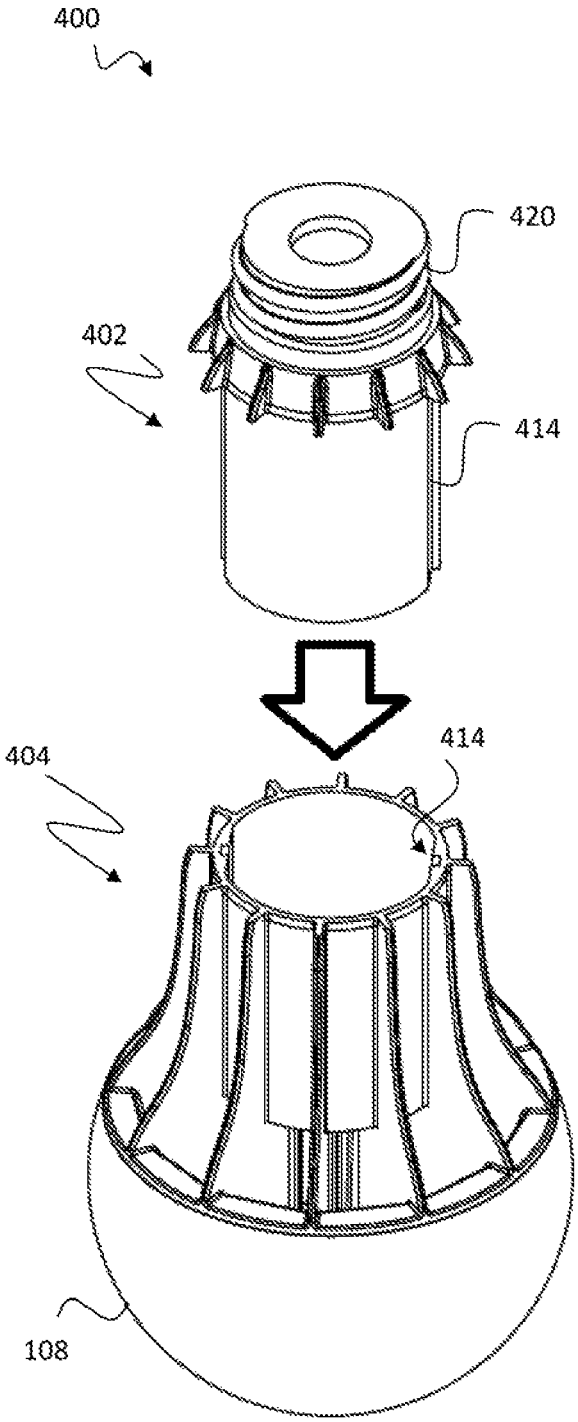
FIG. 4 illustrates a perspective view of a separable isolator that houses a driver circuit of a lighting apparatus in accordance with embodiments of the present invention.

Referring now to FIG. 4, a perspective view of a lighting apparatus 400 including a separable isolator 402 (housing for driver circuitry) is illustrated in accordance with embodiments of the present invention. Advantageously, driver circuitry within isolator 402 is isolated from the heat sink without using any fill materials in between but is electrically couplable to the PCBs (e.g., via a cable channel 140).

In accordance with an embodiment, isolator 402 can be easily fastened in the right position inside heat sink 404 by using linear rails on an outer surface of isolator 402 and linear grooves 414 on an inner surface of heat sink 404. In accordance with another embodiment, isolator 402 can be fastened inside heat sink 404 by being screwed on specifics points on the heat sink. In one example, isolator 402 can be fastened inside 20 heat sink 404 by adding screw guides on the inner surface of the heat sink 404 and outer surface of isolator 402. In another example, isolator 402 can be fastened inside heat sink 404 by melting a part (such as a tab or drop) on the heat sink, for example by using an apparatus which conducts heat to such a part that can be melted and resolidified.

In accordance with an embodiment, isolator 402 can be vertically divided into two pieces for placing a larger electronic driver circuit within (since the size of the other placement direction is limited). The two pieces can be put together after placing the electronic driver circuit inside one of the pieces of the isolator. Then the assembled isolator can be placed into the heat sink.

Isolator 402 can be fastened to an Edison lamp holder by adding a screw guide 420 on an end of the isolator. It is noted that the isolator can be stronger fastened to an Edison lamp holder by clinching the lamp holder on specific points to the isolator.

Advantageously, the lighting apparatus in accordance with embodiments of the present invention, integrate the optical structure (LED, phosphor-like materials, diffuser, reflector), thermal structure (heat sink), and electronic circuit members in a highly efficient manner for increased lumen extraction and cooling efficiency while maintaining weight and size constraints of a bulb. For example, the area covered by the lighting apparatus embodiments of the present invention remains within A19 limits and the lighting system has a low weight. The temperature of LED chips that determine the luminous efficacy, light quality, system reliability, and life span, are maintained at a lower level when compared to the current state of the art.

Figure 5:
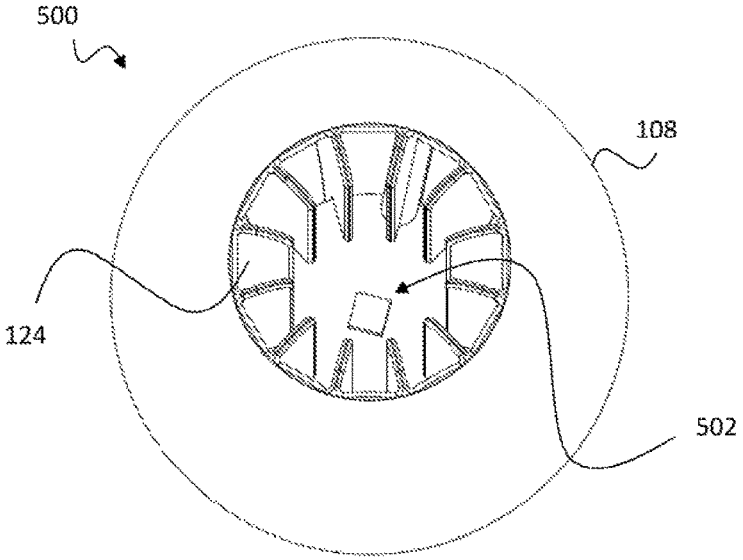
FIGS. 5, 6, and 7 illustrate lighting apparatus with sensors in accordance with embodiments of the present invention.
Figure 6:
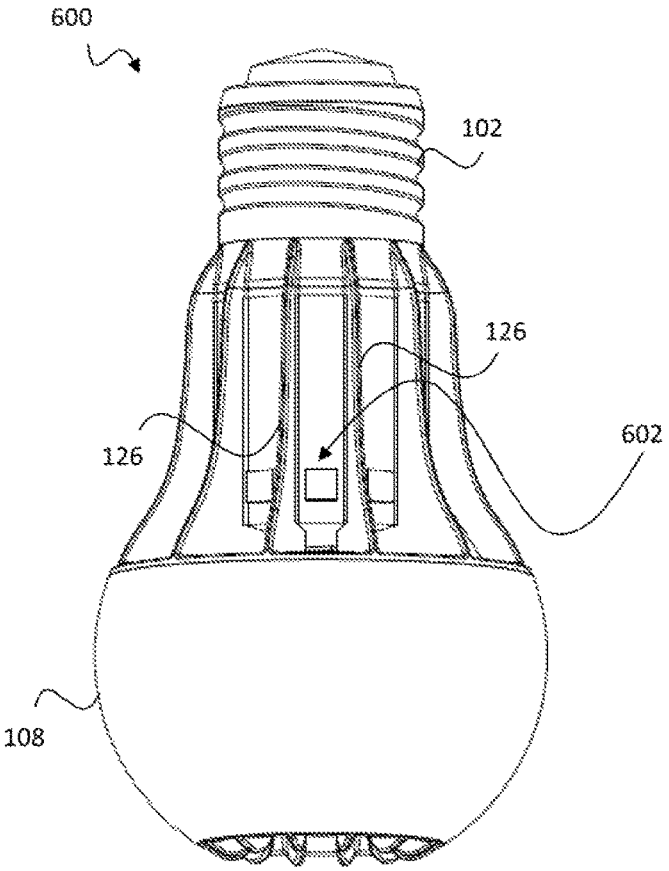
Figure 7:
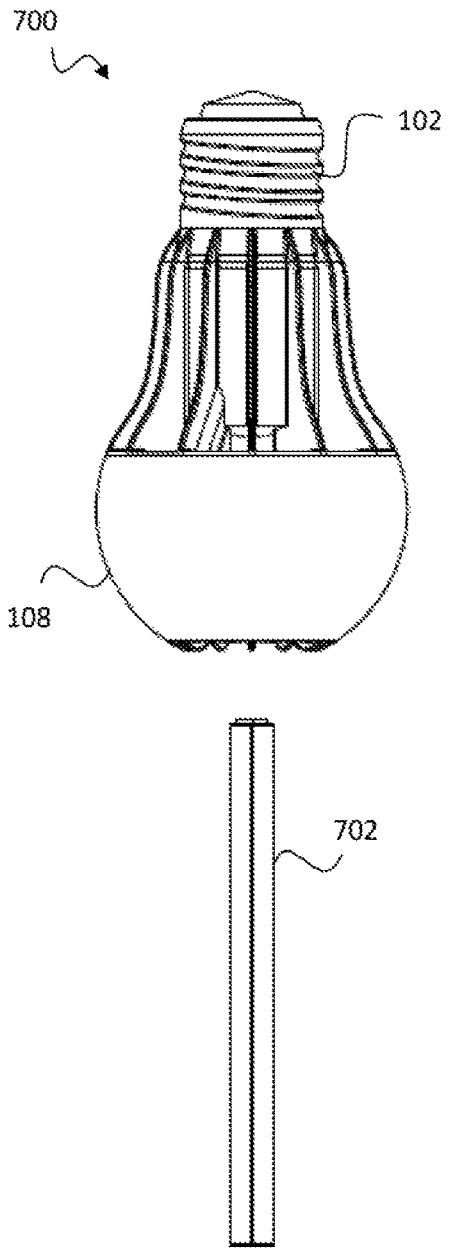

Referring now to FIGS. 5, 6, and 7, lighting apparatus 500, 600, and 700, with sensors 502, 602, and 702, respectively, are illustrated in accordance with embodiments of the present invention. A sensor 502, 602, 702 may be placed within a flow channel or the center passageway, the sensor configured to measure a parameter selected from the group consisting of temperature, visible radiation (e.g., color and/or lumen amount), combustion product, orientation, sound, motion, humidity, and/or the like.

The lighting apparatus may further include a device machine 111 (such as a transceiver, processor, and/or the like) configured to send and receive parameter data through an access point to the Internet (see, for example, FIG. 1E). In one example, device machine 111 is a communication module configured to upload and/or download or transmit data about the environment, by one of various means, such as via a wireless protocol (e.g., wifi) or satellite systems.

In one example, a sensor can sense ambient temperature via an LED chip forward voltage drift and sense at the driver circuit a voltage drop, and device machine 111 is a transceiver configured to send to and receive parameter data from a building heating and cooling system.

In accordance with an embodiment, a method of controlling a lighting apparatus includes providing a lighting apparatus as disclosed according to any of the embodiments herein. The lighting apparatus includes a sensor within a flow channel or the center passageway, with the sensor configured to detect temperature, visible radiation, combustion product, orientation, sound, motion, humidity, and/or the like. The lighting apparatus further includes a device machine (e.g., device machine 111, 1010), that may include communication means, such as a transceiver, a processor, and/or the like, configured to send and receive data through an access point to the Internet. The method further comprises sensing a parameter with the sensor, transmitting a parameter data signal through the device machine regarding the parameter, and receiving a control signal through the device machine regarding the parameter. In one embodiment, sensing of the parameter includes sensing one of temperature, visible radiation, combustion product, orientation, sound, motion, and humidity.

In accordance with alternative embodiments, the method of controlling a lighting apparatus may further comprise adjusting the electrical output that operates the LEDs based upon the received control signal.

The following are some example applications and methods for controlling a lighting apparatus (controlled lighting) using any of the embodiments of a lighting apparatus as described herein.

For very hot environments with a very high luminous flux requirement, a fan can be integrated at the center passageway. Sensors near to LEDs and/or the driver circuit may communicate with a control unit of the fan to turn on (or off) the fan, until the temperatures of electronics are in a safe region.

A light sensor (e.g., a passive infrared (PIR) sensor) can be modified near the top of the conical section of the driver circuit housing (see, for example, a sensor in FIG. 5). Prior lighting systems may sense light, but prior systems have sensed light, which is emitted by the lamp itself, which can mislead the system in calculating the light intensity requirement for the environment. In accordance with an embodiment, direct light rays from the LEDs do not reach the light sensor, which makes a light intensity calculation simple yet accurate, thus allowing for more accuracy in controlling or adjusting emitted light power.

In one example, a sensor for sensing combustion products such as NOx and CO is attached on the top of the conical section of the driver circuit housing (see, for example, a sensor in FIG. 5). Due to the chimney effect, ambient air is very quickly guided to the middle section of the center opening. This brings a very quick sensing of chemical changes in the ambient. With a communication module it will bring ALARM-ON for the fire and communicates with the local fire department through a communication module (GPS, wifi, etc).

Sensor apparatus makes it possible to change the sensor on the conical section easily and safely. It also means that only authorized people can change the sensors.

The temperature of the LEDs changes the voltage-current relationship. A calibration curve may be created (Tchip-Voltage), and a self-check temperature algorithm may be included in the microprocessor for the data execution, decision making, and communication. This will enable more accurate temperature measurements, such as for room temperature, and in deciding if a fire situation arises (e.g., assume Troom=22 Celsius and Tchip=60 Celsius, if Tchip=120 Celsius and Troom>80 C).

In further embodiments, multiple temperature readings from multiple lighting fixtures and lamps are made available, simultaneously and/or over time, enabling many temperature readings in a building environment. This data can be compiled and communicated with a control system, such as a central or local air conditioning or heating system or fresh air supply system, for example, which is advantageous over current systems that only collect data at one or two points within a system.

Light sensors can be integrated above the driver circuit housing and between the external heat sink fins (see, e.g., sensors 602 in FIG. 6). Sensors between the fins outside of the conical section may also be positioned that no direct light emitted by the lamp itself reaches them. In this way a number of sensors can provide light intensity measurements data to create a 3D lighting map of an environment. A control unit may adjust the power of each individual LED to meet the specific 3D lighting requirements of the environment.

The light engine can be separated by dividers between PCBs and LEDs (e.g., dividers 902 in FIG. 9), thus allowing for high control over illuminating an environment based on specific lighting requirements of the environment. Reflectors may be used on both sides of a divider and the mounting plate in order to guide light and reduce light absorption. Reflectors themselves can also be directly used as dividers in other embodiments.

Multiple lamps can cooperate by recognizing the other light sources and understanding the specific lighting requirements of the environment. By using multiple lamps, sensor data can be analyzed by the control lamp or an outside control unit, which can give directions to the lamps, such as in which combination and in which current for individual LEDs of each lamp should be driven.

For example, to indicate a lost object in the environment with a GPS sensor, a lamp may only activate the LEDs in the direction of the lost object in the environment. This feature is only possible due to 3D light engine design with divisions in accordance with embodiments of the present invention.

Sound and/or motion sensors may be integrated on the top of the conical section and between the fins outside of the conical section. For instance in conference rooms, lamps may adjust each individual LED on each lamp to brighten an area where sound is detected. Multiple lamps may cooperate to brighten the correct area by adjusting the power of different LEDs on different positions. Electronic communication may be included between sensors and the driver circuit.

Sound or motion sensors can be integrated on the top of the conical section and between the fins outside of the conical section. For environments, which are shared by many people, a lamp will not brighten the section, in which no sound is generated.

Sound sensors may be integrated on the top of the conical section and between the fins outside of the conical section. In TV mode of a lamp, LEDs in a TV direction can be dimmed to rest the viewer's eyes (or vice versa).

Humidity may be sensed through a humidity sensor or the measurement of the fin temperatures and the determination of the change of the temperature due to a humidity effect.

A micro camera may be placed at the front of a lighting apparatus or for a field of view of 90 degrees each between fins, capturing data and communicating with a microprocessor with communication capability, thus enabling communication with a smart mobile device such as an IOS or ANDRIOD device for viewing data from the micro camera.

A gyroscope sensor (see, e.g., sensor 702 of FIG. 7) may be used to detect orientation and to dim the LEDs on the topside, when the lamp is used in a horizontal orientation. Thus, the ceiling will not be illuminated unnecessarily.

FIG. 8 illustrates a lighting apparatus 800 with groups of LEDs 806 per PCB 804 (and per flow channel) in accordance with embodiments of the present invention.

Figure 9:
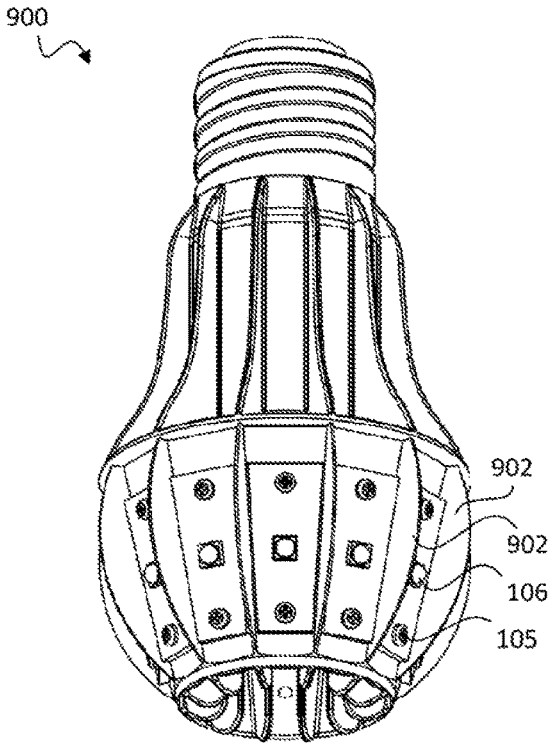
FIG. 9 illustrates a lighting apparatus with dividers between LEDs and PCBs, at the intersection line of flow channels, in accordance with embodiments of the present invention.

FIG. 9 illustrates a lighting apparatus 900 with dividers 902 between PCBs, LEDs, and mounting plates, in accordance with embodiments of the present invention.

Figure 10:
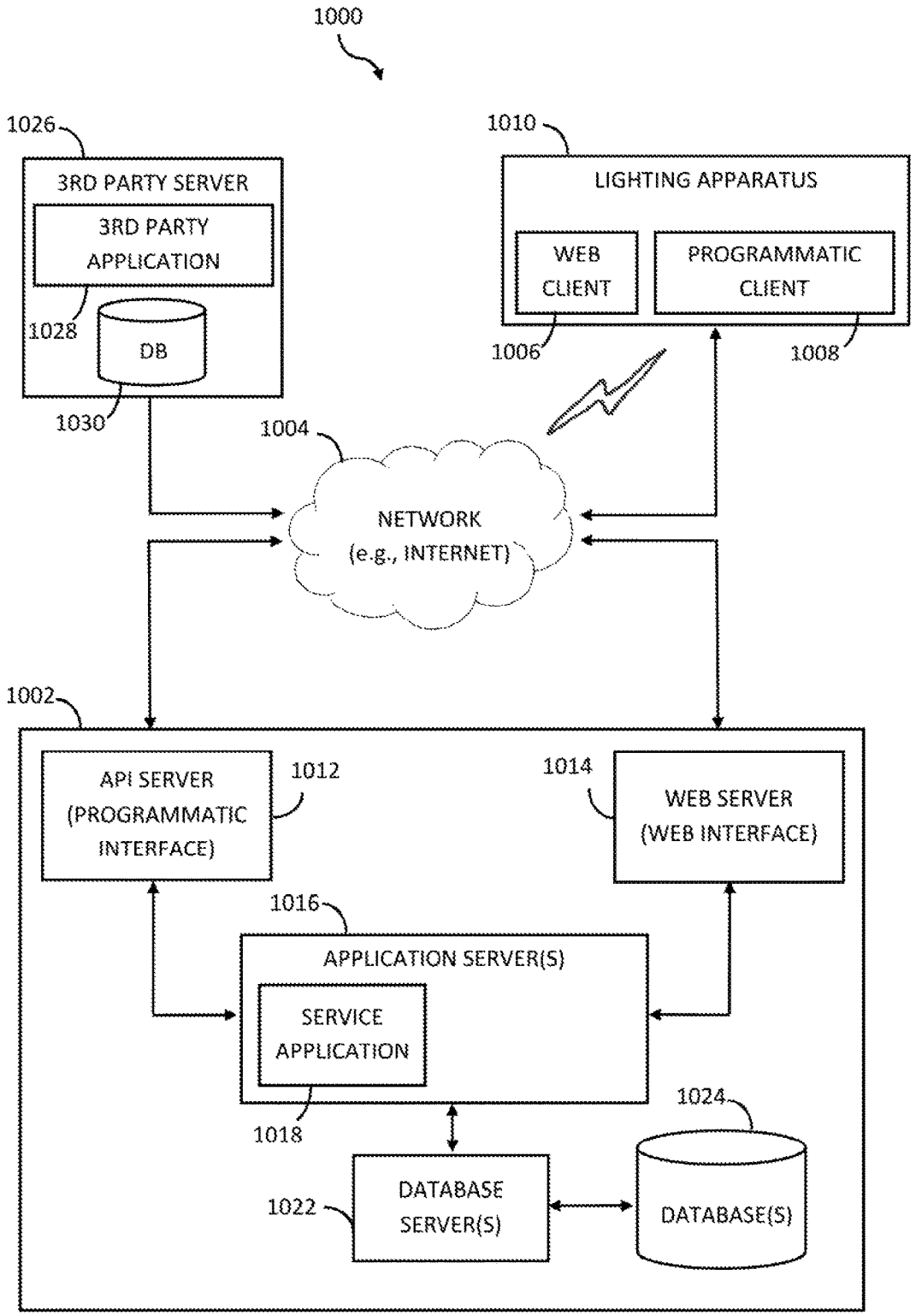
FIG. 10 illustrates a network diagram depicting an example system for performing controlled lighting according to some embodiments of the present invention.

Referring now to FIG. 10, a network diagram depicts an example system 1000 for performing controlled lighting methods according to some embodiments of the present invention. A networked system 1002 forms a network-based publication system that provides server-side functionality, via a network 1004 (e.g., the Internet or Wide Area. Network (WAN)), to one or more clients and devices. FIG. 10 further illustrates, for example, one or both of a web client 1006 (e.g., a web browser) and a programmatic client 1008 executing on device machine 1010 which may be mounted in the lighting apparatus according to any of the embodiments noted above. In one embodiment, the system 1000 comprises a control system, and/or an observation/security system.

Device machine 1010 may comprise a computing device that includes at least communication capabilities with the network 1004 to access the networked system 1002. Device machine 1010 may connect with the network 1004 via a wired or wireless connection. For example, one or more portions of network 1004 may be an ad hoc network, an intranet, an extranet, a virtual private network (VPN), a local area network (LAN), a wireless LAN (WLAN), a wide area network (WAN), a wireless WAN (WWAN), a metropolitan area network (MAN), a portion of the Internet, a portion of the Public Switched Telephone Network (PSTN), a cellular telephone network, a wireless network, a WiFi network, a WiMax network, another type of network, or a combination of two or more such networks.

An Application Program Interface (API) server 1012 and a web server 1014 are coupled to, and provide programmatic and web interfaces respectively to, one or more application servers 1016. The application servers 1016 may host one or more "lighting applications" (e.g., lighting service application 1018) in accordance with an embodiment of the present invention. Application servers 1016 may further include payment applications and other applications that support a lighting service. The application servers 1016 are, in turn, shown to be coupled to one or more databases servers 1022 that facilitate access to one or more databases 1024.

While the lighting application 1018 is shown in FIG. 10 to form part of the networked system 1002, it will be appreciated that, in alternative embodiments, the lighting application may form part of a lighting application service that is separate and distinct from the networked system 1002 or separate and distinct from one another. In other embodiments, the lighting service application 1018 may be omitted from the system 1000. In some embodiments, at least a portion of the lighting applications may be provided on the device machine 1010.

Further, while the system 1000 shown in FIG. 10 employs a client-server architecture, embodiments of the present disclosure is not limited to such an architecture, and may equally well find application in, for example, a distributed or peer-to-peer architecture system. The various service applications 1018 may also be implemented as standalone software programs, which do not necessarily have networking capabilities.

The web client 1006 accesses the various lighting applications 1018 via the web interface supported by the web server 1014. Similarly, the programmatic client 1008 accesses the various services and functions provided by the applications 1018 via the programmatic interface provided by the API server 1012.

The systems, apparatus, and methods according to example embodiments of the present invention may be implemented through one or more processors, servers, and/or client computers in operable communication with one another.

Figure 11:
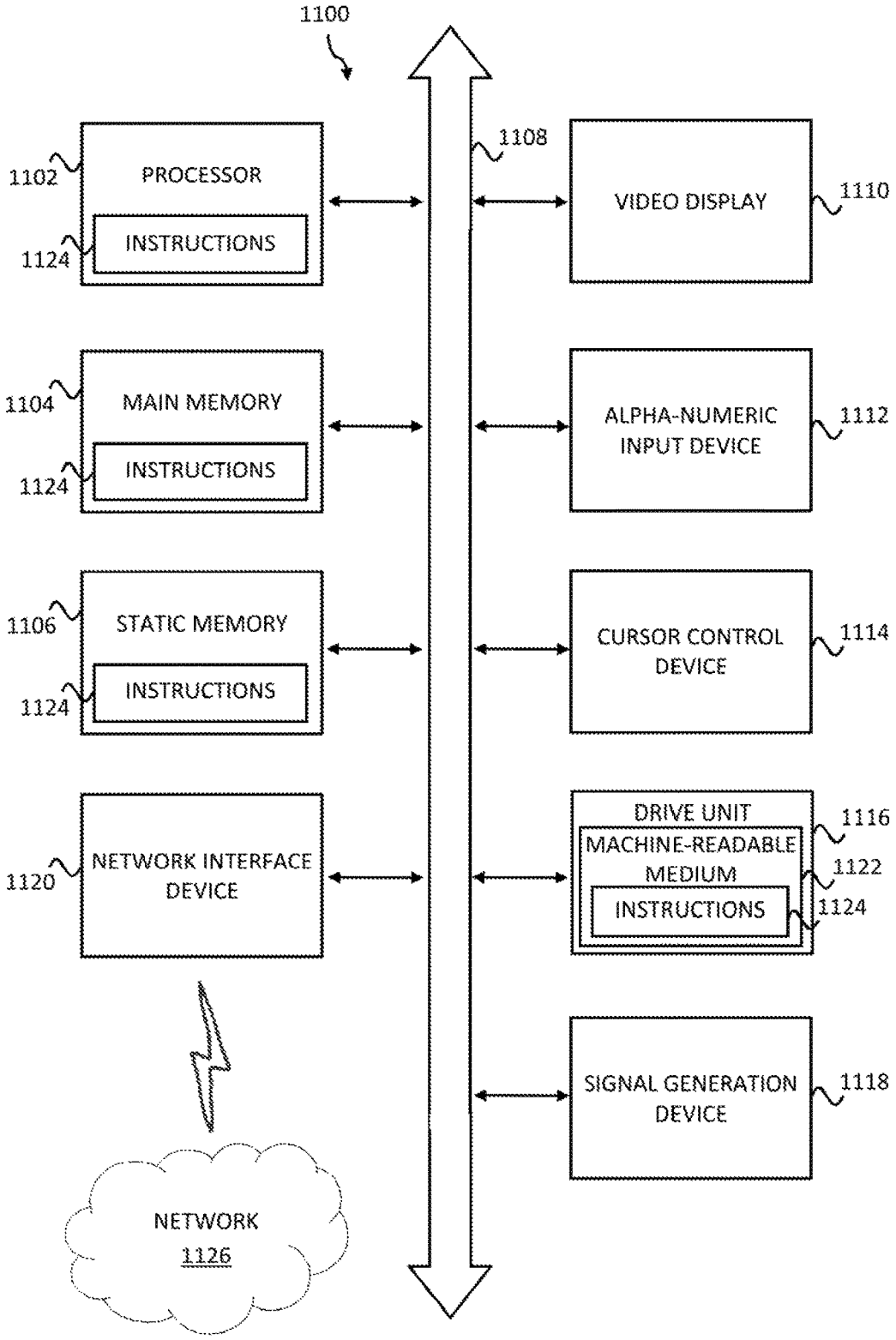
FIG. 11 illustrates a diagrammatic representation of a machine in the example form of a computer system, within which a set of instructions may be carried out for causing a lighting apparatus to perform any one or more of the methods according to some embodiments of the present invention.

FIG. 11 illustrates a diagrammatic representation of a machine 100 in the example form of a computer system, within which a set of instructions may be carried out for causing a lighting apparatus to perform any one or more of the methods according to some embodiments of the present invention.

The computer system 1100 comprises, for example, any of the device machine 1010, applications servers 1016, API server 1012, web server 1014, database servers 1022, or third party server 1026. In alternative embodiments, the machine operates as a standalone device or may be connected (e.g., networked) to other machines. In a networked deployment, the machine may operate in the capacity of a server or a device machine in server-client network environment, or as a peer machine in a peer-to-peer (or distributed) network environment. The machine may be a server computer, a client computer, a personal computer (PC), a tablet, a set-top box (STB), a Personal Digital Assistant (PDA), a smart phone, a cellular telephone, a web appliance, a network router, switch or bridge, or any machine capable of executing a set of instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 1100 includes a processor 1102 (e.g., a central processing unit (CPU), a graphics processing unit (GPU), or both), a main memory 1104 and a static memory 1106, which communicate with each other via a bus 1108. The computer system 1100 may further include a video display unit 1110 (e.g., liquid crystal display (LCD), inorganic/organic light emitting diode (LED/OLED), touch screen, or a cathode ray tube (CRT)). The computer system 1100 also includes an alphanumeric input device 1112 (e.g., a physical or virtual keyboard), a cursor control device 1114 (e.g., a mouse, a touch screen, a touchpad, a trackball, a trackpad), a disk drive unit 1116, a signal generation device 1118 (e.g., a speaker) and a network interface device 1120.

The disk drive unit 116 includes a machine-readable medium 1122 on which is stored one or more sets of instructions 1124 (e.g., software) embodying any one or more of the methodologies or functions described herein. The instructions 1124 may also reside, completely or at least partially, within the main memory 1104 and/or within the processor 1102 during execution thereof by the computer system 1100, the main memory 1104 and the processor 1102 also constituting machine-readable media.

The instructions 1124 may further be transmitted or received over a network 1126 via the network interface device 1120.

While the machine-readable medium 1122 is shown in an example embodiment to be a single medium, the term "machine-readable medium" should be taken to include a single medium or multiple media (e.g., a centralized or distributed database, and/or associated caches and servers) that store the one or more sets of instructions. The term "machine-readable medium" shall also be taken to include any medium that is capable of storing, encoding or carrying a set of instructions for execution by the machine and that cause the machine to perform any one or more of the methodologies of the present invention. The term "machine-readable medium" shall accordingly be taken to include, but not be limited to, solid-state memories, optical and magnetic media, and carrier wave signals.

It will be appreciated that, for clarity purposes, the above description describes some embodiments with reference to different functional units or processors. However, it will be apparent that any suitable distribution of functionality between different functional units, processors or domains may be used without detracting from the invention. For example, functionality illustrated to be performed by separate processors or controllers may be performed by the same processor or controller. Hence, references to specific functional units are only to be seen as references to suitable means for providing the described functionality, rather than indicative of a strict logical or physical structure or organization.

Certain embodiments described herein may be implemented as logic or a number of modules, engines, components, or mechanisms. A module, engine, logic, component, or mechanism (collectively referred to as a "module") may be a tangible unit capable of performing certain operations and configured or arranged in a certain manner. In certain example embodiments, one or more computer systems (e.g., a standalone, client, or server computer system) or one or more components of a computer system (e.g., a processor or a group of processors) may be configured by software (e.g., an application or application portion) or firmware (note that software and firmware can generally be used interchangeably herein as is known by a skilled artisan) as a module that operates to perform certain operations described herein.

In various embodiments, a module may be implemented mechanically or electronically. For example, a module may comprise dedicated circuitry or logic that is permanently configured (e.g., within a special-purpose processor, application specific integrated circuit (ASIC), or array) to perform certain operations. A module may also comprise programmable logic or circuitry (e.g., as encompassed within a general-purpose processor or other programmable processor) that is temporarily configured by software or firmware to perform certain operations. It will be appreciated that a decision to implement a module mechanically, in dedicated and permanently configured circuitry, or in temporarily configured circuitry (e.g., configured by software) may be driven by, for example, cost, time, energy-usage, and package size considerations.

Accordingly, the term "module" should be understood to encompass a tangible entity, be that an entity that is physically constructed, permanently configured (e.g., hardwired), non-transitory, or temporarily configured (e.g., programmed) to operate in a certain manner or to perform certain operations described herein. Considering embodiments in which modules or components are temporarily configured (e.g., programmed), each of the modules or components need not be configured or instantiated at any one instance in time. For example, where the modules or components comprise a general-purpose processor configured using software, the general-purpose processor may be configured as respective different modules at different times. Software may accordingly configure the processor to constitute a particular module at one instance of time and to constitute a different module at a different instance of time.

Modules can provide information to, and receive information from, other modules. Accordingly, the described modules may be regarded as being communicatively coupled. Where multiples of such modules exist contemporaneously, communications may be achieved through signal transmission (e.g., over appropriate circuits and buses) that connect the modules. In embodiments in which multiple modules are configured or instantiated at different times, communications between such modules may be achieved, for example, through the storage and retrieval of information in memory structures to which the multiple modules have access. For example, one module may perform an operation and store the output of that operation in a memory device to which it is communicatively coupled. A further module may then, at a later time, access the memory device to retrieve and process the stored output. Modules may also initiate communications with input or output devices and can operate on a resource (e.g., a collection of information).

Although the present invention has been described in connection with some embodiments, it is not intended to be limited to the specific form set forth herein. One skilled in the art would recognize that various features of the described embodiments may be combined in accordance with the invention. Moreover, it will be appreciated that various modifications and alterations may be made by those skilled in the art without departing from the scope of the invention.

The Abstract is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter may lie in less than all features of a single disclosed embodiment.

Embodiments of the present invention may be embodied as a system, method, or computer program product (e.g., embodiments directed toward an image searching system, method, or computer program product). Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit", "module", or "system". For example, an image searching method may be embodied in a software and hardware system that can be housed in a portable device such as a tablet, laptop, camera, phone, and the like. In another example, a client and server computer in operable communication and combination, may be in its entirety said to be embodied in a system. Furthermore, aspects of the present embodiments of the disclosure may take the form of a computer program product embodied in one or more computer readable medium/media having computer readable program code embodied thereon. Methods may be implemented in a special-purpose computer or a suitably programmed general-purpose computer.

Any combination of one or more computer readable medium/media may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing. Computer program code for carrying out operations for aspects of the present embodiments of the disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present embodiments of the disclosure are described above with reference to flowchart illustrations and/or block diagrams of methods, apparatus (systems) and computer program products according to embodiments of the present invention (e.g., FIGS. 1-9). It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Although the invention has been described in detail in connection with only a limited number of embodiments, it should be readily understood that the invention is not limited to such disclosed embodiments. Rather, the invention can be modified to incorporate a number of variations, alterations, substitutions, combinations or equivalent arrangements not heretofore described, but which are commensurate with the spirit and scope of the invention. For example, the use of different diffuser materials, different number of heat sink fins, and different angles within a range are within the scope of the present invention. Furthermore, the various components that make up the lighting system, apparatus, and methods disclosed above can be alternatives which may be combined in various applicable and functioning combinations within the scope of the present invention. Additionally, while various embodiments of the invention have been described, it is to be understood that aspects of the invention may include only some of the described embodiments. Accordingly, the invention is not to be seen as limited by the foregoing description but is only limited by the scope of the appended claims.

The invention claimed is:

1. A lighting apparatus comprising;
- a connection socket adapted to transmit electricity;
- a plurality of printed circuit boards (PCBs);
- an LED mounted on each of said plurality of PCBs to provide a plurality of LEDs;
- a diffuser positioned over the plurality of LEDs to diffuse light generated by the plurality of LEDs;
- an electronic driver circuit electrically connected to said connection socket and to the plurality of PCBs so as to convert electricity from said connection socket to an electrical output that operates the plurality of LEDs, said electronic driver circuit mounted in a driver circuit housing; and
- a heat sink comprising:
  - a center passageway passing from a chimney inlet to the driver circuit housing;
  - a plurality of internal heat sink fins within the center passageway;
  - a plurality of external heat sink fins adjacent the driver circuit housing; and
  - a flow channel between each set of two adjacent heat sink fins of the plurality of internal heat sink fins and the plurality of external heat sink fins to provide a plurality of internal inlet flow channels and a plurality of external outlet flow channels, with each flow channel aligned with one of the plurality of PCBs.

2. The lighting apparatus of claim 1, wherein each of the plurality of PCBs are angularly positioned concentric about said center passageway at an angle (m) between 70 degrees and 90 degrees from a face of the chimney inlet.

3. The lighting apparatus of claim 1, wherein the chimney inlet has a diameter substantially identical to a diameter of the driver circuit housing.

4. The lighting apparatus of claim 1, wherein said plurality of external heat sink fins extend between the driver circuit housing and said diffuser, and wherein said plurality of internal heat sink fins extend between the driver circuit housing and the chimney inlet.

5. The lighting apparatus of claim 1, wherein a number of heat sink fins of the pluralities of internal and external heat sink fins is 24.

6. The lighting apparatus of claim 1, wherein the driver circuit housing has a right circular cone surface with an apex centered within said center passageway, the right circular cone surface having an apex angle (n) greater than 120 degrees.

7. The lighting apparatus of claim 1, wherein said connection socket is suitable for indoor A19, PAR38, MR16, PAR20 and downlight lamps.

8. The lighting apparatus of claim 1, further comprising;

a cable channel within one of the plurality of internal and external heat sink fins between one of the PCBs and the driver circuit.

9. The lighting apparatus of claim 1, said heat sink further comprising:

an electrical insulating layer positioned between said heat sink and said electronic driver circuit, said electrical insulating layer having a conical section positioned at least partially within said center passageway.

10. The lighting apparatus of claim 1, further comprising:

a phosphor positioned at a location selected from the group consisting of a lower surface of said diffuser, on an LED, within said diffuser, and a combination thereof.

11. The lighting apparatus of claim 1, further comprising:

a plurality of mounting plates angularly positioned concentric about said center passageway and between said diffuser and the chimney inlet, each of said plurality of mounting plates positioned at an angle (m) between 70 degrees and 90 degrees from a face of the chimney inlet.

12. The lighting apparatus of claim 11, wherein each of said plurality of mounting plates has a first end positioned adjacent to the chimney inlet and a second end positioned adjacent to an intersection between the plurality of internal and external heat sink fins and said diffuser.

13. The lighting apparatus of claim 1, further comprising:

a sensor within said flow channel or said center passageway, the sensor configured to measure a parameter selected from the group consisting of temperature, visible radiation, combustion product, orientation, sound, motion, and humidity; and a communication module configured to transmit and receive parameter data to and from a building heating and cooling system.

14. A lighting apparatus comprising:

a connection socket adapted to transmit electricity;

a plurality of printed circuit boards (PCBs);

an LED mounted on each of the plurality of PCBs to provide a plurality of LEDs;

a diffuser positioned over the LEDs to guide and diffuse light generated by the plurality of LEDs;

an electronic circuit electrically connected to the connection socket and to the PCBs so as to convert electricity from said connection socket to an electrical output that operates the plurality of LEDs, said electronic driver circuit mounted in a driver circuit housing; and a heat sink including:

a center passageway passing from a chimney inlet to said driver circuit housing, the chimney inlet allowing air to enter into said center passageway;

a plurality of internal heat sink fins within said center passageway and cooperative with the plurality of LEDs, wherein said plurality of internal heat sink fins extend between the driver circuit housing and the chimney inlet;

a plurality of external heat sink fins adjacent the driver circuit housing and cooperative with said electronic driver circuit, wherein said plurality of external heat sink fins extend between the driver circuit housing and said diffuser; and a flow channel between each set of two adjacent heat sink fins of the plurality of internal and external heat sink fins to provide a plurality of internal inlet flow channels and a plurality of external outlet flow channels, with each of the external outlet flow channels aligned with one of the plurality of inlet flow channels and one of the plurality of PCBs; and a plurality of mounting plates, each mounting plate of the plurality of mounting plates having a first end positioned adjacent to the chimney inlet and a second end positioned adjacent to an intersection between the plurality of internal and external heat sink fins and the diffuser;

wherein each of the plurality of PCBs is mounted on one of said plurality of mounting plate and is angularly positioned concentric about said center passageway between said diffuser and the chimney inlet at an angle (m) between 70 degrees and 90 degrees from a face of the chimney inlet.

15. The lighting apparatus of claim 14, the comprising:

a cable channel within one of the plurality of internal heat sink fins and plurality of external heat sink fins between the PCB and the driver circuit.

16. The lighting apparatus of claim 14, wherein the driver circuit housing has a right circular cone surface with an apex centered within said center passageway, the right circular cone surface having an apex angle greater than 120 degrees.

17. The lighting apparatus of claim 14, further comprising:

a sensor within a flow channel or said center passageway, said sensor configured to measure a parameter selected from the group consisting of temperature, visible radiation, a combustion product, orientation, sound, motion, and humidity; and a transceiver configured to send and receive parameter data through an access point to the Internet.

18. A method of controlling a lighting apparatus, the method comprising:

providing a lighting apparatus having a connection socket adapted to transmit electricity, a plurality of printed circuit boards (PCBs), an LED mounted on each of the plurality of PCBs to provide a plurality of LEDs, a diffuser positioned over the plurality of LEDs to diffuse light generated by the plurality of LEDs, an electronic driver circuit electrically connected to the connection socket and to the plurality of PCBs so as to convert electricity from the connection socket to an electrical output that operates the plurality of LEDs, the electronic driver circuit mounted in a driver circuit housing, and a heat sink having a center passageway passing from a chimney inlet to the driver circuit housing, a plurality of internal heat sink fins within the center passageway, a plurality of external heat sink fins adjacent the driver circuit housing, and a flow channel between each set of two adjacent heat sink fins of the plurality of internal heat sink fins and the plurality of external heat sink to provide a plurality of flow channels with each flow channel aligned with one of the plurality of PCBs, the lighting apparatus also having a sensor within one of the plurality of flow channels or the center passageway, the sensor configured to detect one of temperature, visible radiation, combustion product, orientation, sound, motion, and humidity, and a transceiver configured to send and receive data through an access point to the Internet;

sensing a parameter with the sensor;

transmitting a parameter data signal through the transceiver regarding the parameter; and receiving a control signal through the transceiver regarding the parameter.

19. The method of claim 18, wherein sensing of the parameter includes sensing one of temperature, visible radiation, combustion product, orientation, sound, motion, and humidity.

20. The method of claim 18, further comprising:

adjusting the electrical output that operates the plurality of LEDs based upon the received control signal.

* * * * *